United States Patent [19]

Christie

[11] 4,363,405

[45] Dec. 14, 1982

[54] DISPENSING CARTON FOR PLASTIC GROCERY BAGS

[76] Inventor: Eugene P. Christie, 543 Granville, Hillside, Ill. 60162

[21] Appl. No.: 284,941

[22] Filed: Jul. 20, 1981

[51] Int. Cl.[3] ..... B65D 85/62; B65B 67/04; A47F 7/00

[52] U.S. Cl. ..... 206/554; 206/44 R; 206/526; 220/407; 248/100

[58] Field of Search ..... 206/554, 526, 45.12, 206/44 R; 220/407; 229/54 R; 248/100

[56] References Cited

U.S. PATENT DOCUMENTS

| | | | |
|---|---|---|---|
| 2,725,141 | 11/1955 | Latuala et al. | 206/554 |
| 2,916,183 | 12/1959 | Ariens | 220/407 |
| 3,747,298 | 7/1973 | Lieberman | 248/100 |
| 3,774,838 | 11/1973 | Christie | 229/54 R |
| 4,116,330 | 9/1978 | Ellis | 206/45.12 |
| 4,165,832 | 8/1979 | Kuklies et al. | 229/54 R |

*Primary Examiner*—William T. Dixson, Jr.
*Attorney, Agent, or Firm*—John S. Fosse

[57] ABSTRACT

A disposable shipper-dispenser comprises telescopingly assemblage carton top and bottom members. The bottom member includes spaced sidewalls, an open top and an open front. The sidewalls have downwardly and forwardly inclined bag-handle-guide edge portions and a vertically extending intermediate edge portion defining a stop at the forward end of the inclined portion. Each of the sidewalls additionally includes a vertical front edge which is spaced forwardly from the stop edges to define a bag-handle spreader-hanger therebetween.

5 Claims, 5 Drawing Figures

DISPENSING CARTON FOR PLASTIC GROCERY BAGS

BACKGROUND OF THE INVENTION

This invention relates generally to the art of flexible film bags for consumer use as grocery bags or trash bags; and the present invention relates more particularly to devices for supporting these comparatively limp bags in open condition ready to be loaded or charged with grocery contents.

The heretofore ubiquitous kraft paper bags that are commonly used to sack groceries at supermarket check-out counters are advantageously self-supporting in the opened state and are therefore easily loaded. Moisture-resistant and more economical flexible plastic film bags are too limp to be free-standing; and consequently, various types of holders have been devised in the past for supporting bags of the latter type while they are being filled. Such prior art bag-supporting apparatus have been conceived of as rugged pieces of equipment fabricated from sheet metal, wood or heavy gauge wire and intended for repeated use over long periods of time. One such device for supporting open-top plastic bags is disclosed in U.S. Pat. No. 4,062,170 granted to William George Orem. However, the Orem device is designed for use with packs of 50–100 individual bags heat-sealed or otherwise connected together and perforated with aligned, peg-receiving holes. Use of the Orem bag holder starts with manually tearing off the top bag from the heat-sealed pack, an awkward operation at best with slippery plastic bags; and in addition, the Orem device exhibits a constant hazard for cuts and gashes from the exposed edges of the sheet metal material of construction.

SUMMARY OF THE INVENTION

The instant invention, in contravention of the concepts of the prior art, presents a disposable corrugated box-board shipping container which, with the aid of an inexpensive wire clip, is arranged to double as a support for holding open and upright, one-at-a-time, the plastic film bags which are transported therein in commercial quantity. The shipper-dispenser of the invention is compact and entirely self-contained and is both convenient and safe to use. It is also readily disposable and, except for the wire clip, can be completely incinerated. Moreover, the instant shipper-dispenser is especially adapted to take advantage of the features of the plastic bag disclosed and claimed in my U.S. Pat. No. 3,774,838 and presents the tie-handle bag thereof in a convenient position for easy, quick, knotted closure after it has received its intended contents.

Accordingly, a general object of the present invention is to provide a new and improved bag support device for use with flexible film bags.

Other objects and features of the invention pertain to the particular structures and arrangements by which this object is attained.

BRIEF DESCRIPTION OF THE DRAWINGS

The invention, both as to its construction and its mode of use, will be better understood by reference to the following disclosure and drawings forming a part thereof, wherein.

DETAILED DESCRIPTION OF THE INVENTION

Figure 1:
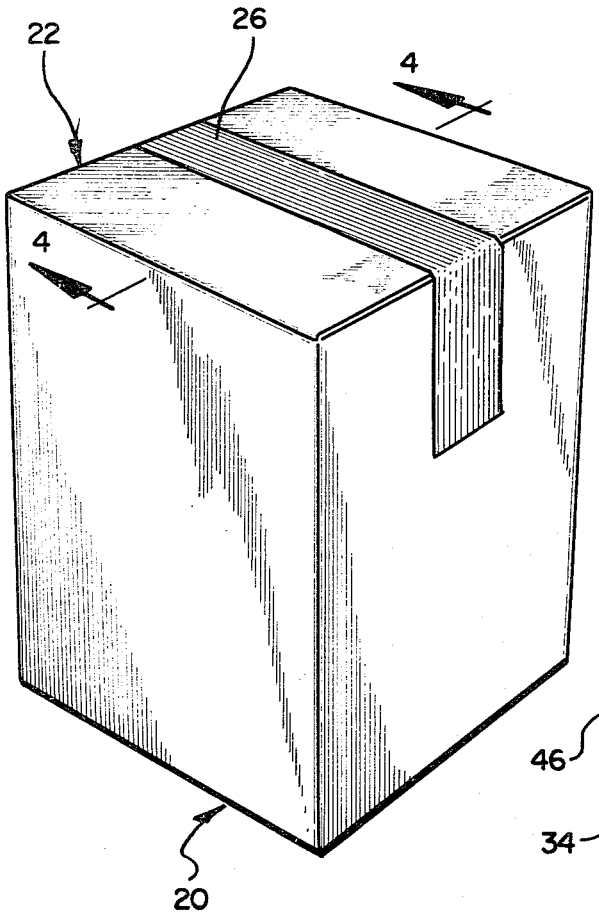
FIG. 1 is a perspective view of a disposable shipper-dispenser constructed in compliance with the present invention.
Figure 2:
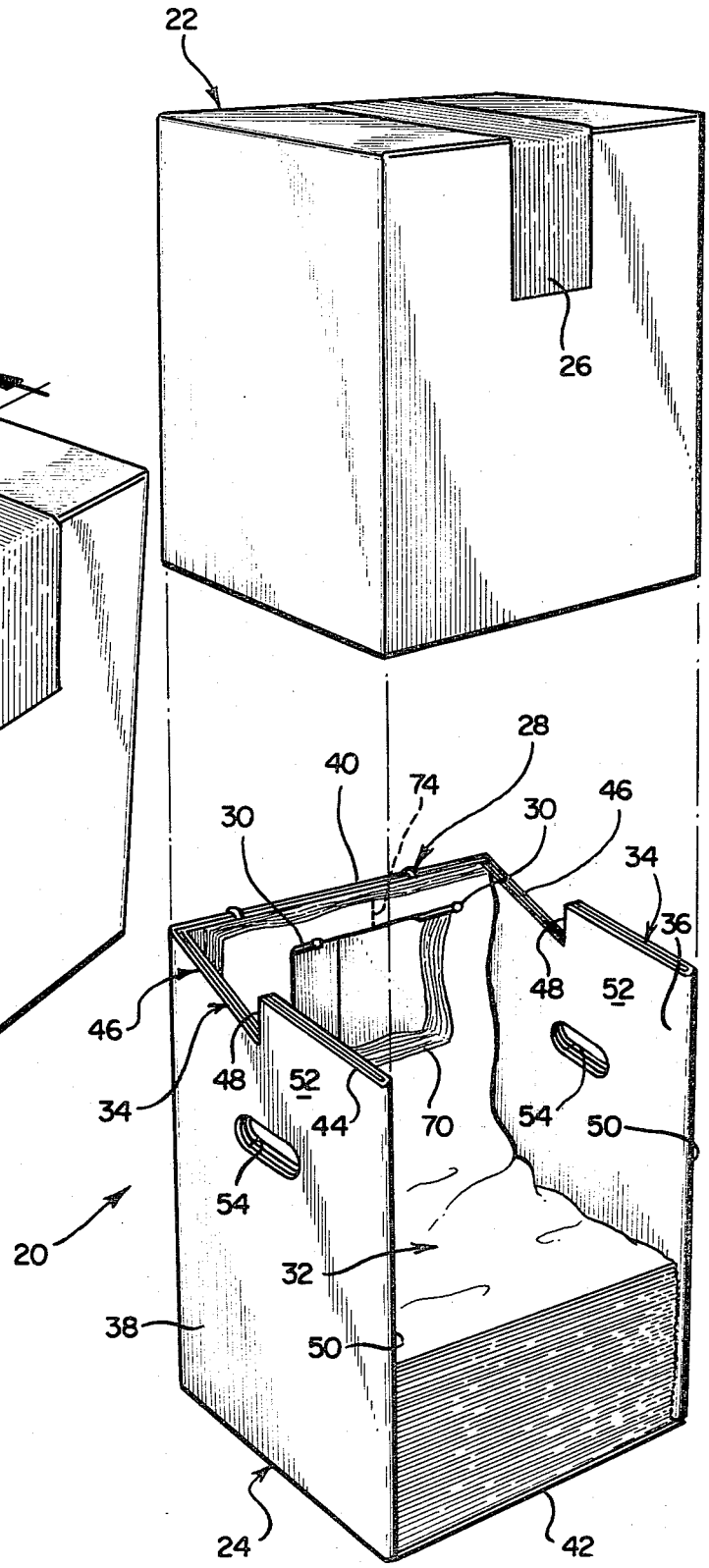
FIG. 2 is a partially exploded perspective view of the shipper-dispenser of FIG. 1, showing the carton top member lifted off to reveal the construction of the carton bottom member and the plastic film bag contents.

Referring now in detail to the drawings, specifically to FIGS. 1 and 2, a disposable shipper-dispenser for plastic film bags is illustrated generally by the reference numeral 20 and broadly comprises a carton top member 22 and a carton bottom member 24. Both of the carton members 22 and 24 are advantageously fabricated from corrugated boxboard in order to eliminate the presence of sharp metal edges and in order that the shipper-dispenser may be both economical and disposable.

The carton top member 22 comprises a parallelepipidon having an open bottom and is conveniently fabricated from a single thickness of the corrugated boxboard, being permanently assembled with a suitable number of strips of adhesive tape 26. The carton top member 22 is arranged to telescope slidably over the carton member 24 for ease in shipment; and the two carton members are temporarily assembled using peel-off tape, not shown.

In addition to the carton members 22 and 24, the shipper-dispenser 20 comprises a bent wire clip 28 which is mountable at the top edge of the back panel of the bottom carton member, as shown in FIG. 2; and the clip 28 includes laterally spaced, forwardly extending generally horizontal fingers 30 which receive and store a stack of loose, tie-handle bags 32 in ready-to-use condition. Since the carton bottom member 24 is intended to serve as a dispenser, it is fabricated in multi-layer construction as indicated by the reference numerals 34 in FIG. 2.

The carton bottom member 24 comprises spaced sidewall elements 36 and 38 which are interconnected by a back panel 40 and a bottom panel 42, the elements 36, 38, 40 and 42 defining a substantially open top and a substantially open front.

In compliance with the features of the present invention, each of the sidewall elements 36 and 38 is provided with a top edge 44 which includes a downwardly and forwardly inclined bag-handle-guide edge portion 46 and a substantially vertically extending intermediate edge portion 48 which defines a stop at the forward end of the inclined guide edge portion 46.

Furthermore, each of the sidewall elements 36 and 38 includes a vertical front edge 50 which is spaced forwardly apart from the respective vertically extending top edge stop portion 48 in order to define a bag-handle spreader-hanger 52 therebetween. The sidewall elements 36 and 38 are advantageously perforated with hand-hold grips 54 for facility in transport of the loaded carton bottom member 24 from one use site to another.

Figure 4:
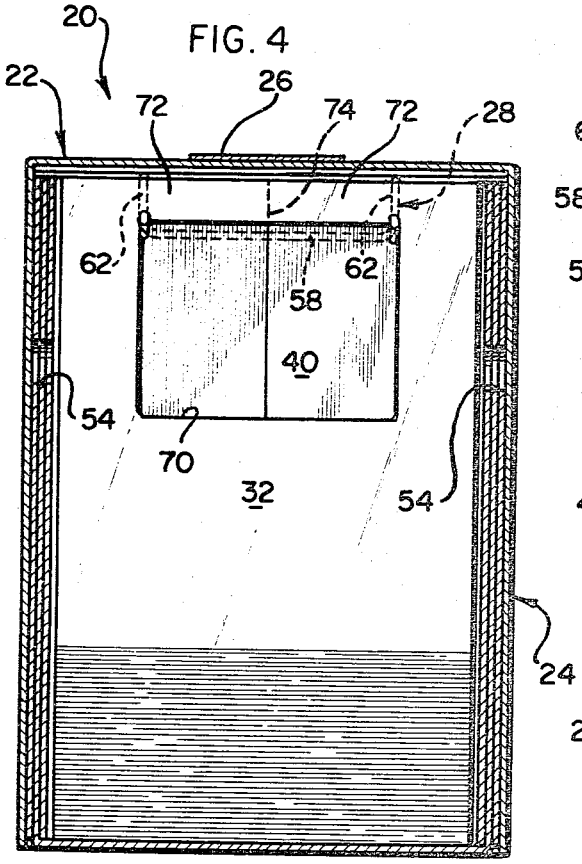
FIG. 4 is a side elevational view in central section taken through the shipper-dispenser of FIG. 1 along the line 4—4 of that figure.
Figure 5:
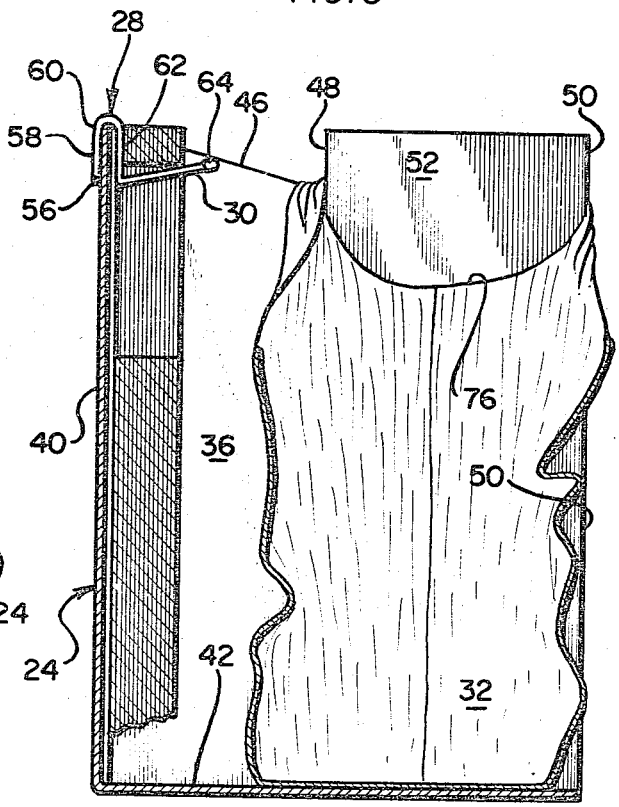
FIG. 5 is a side elevational view taken substantially along the line 5—5 of FIG. 3 to illustrate still further the use mode.

Turning to a consideration of FIGS. 4 and 5, the bent wire clips 28 comprise a horizontally disposable back bar 56 which terminates at its respective ends in vertical rods 58, rods 58 in turn merging into bight portions 60 and downwardly extending rod arms 62 that cooperate with the rods 58 in forming the clips. The fingers 30, previously described, emanate from the rod arms 62 and are desirably provided with protective caps 64 at their outer ends. As is shown in FIG. 5, the fingers 30 may be slightly tilted upwardly to promote storage of the stack of bags 32.

The bags 32 themselves are desirably constructed as is disclosed in my U.S. Pat. No. 3,774,838 to which reference is made for completeness of description. In brief, the film type plastic bags 32 include a struck-out face portion 70, best seen in FIGS. 2 and 4, and tie tabs 72 which are joined at a tear line 74. In addition, the gusseted sides of the bags 32 are apertured with hand openings 76, shown in FIGS. 3 and 5.

Figure 3:
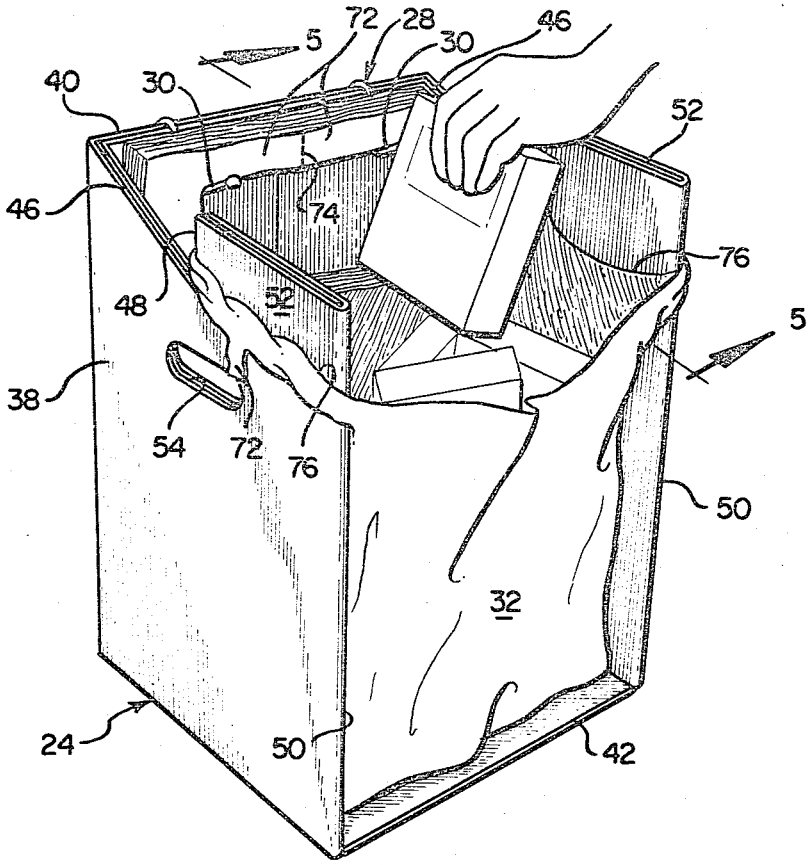
FIG. 3 is a perspective view of the shipper-dispenser of the invention shown in use with one of the plastic film bags supported for charge with grocery contents.

Continuing with reference to FIGS. 3 and 5 for a description of the mode in which the shipper-dispenser 20 is used, it will be apparent that the carton top member 22 will first be disengaged from the carton member bottom 24; and if not preassembled, the bent wire clip 28 will be positioned on the back panel element 40 as illustrated throughout the figures. In such position, a quantity of the bags 32, shipped in the confines of the carton bottom member 24, will be stacked over the fingers 30.

When it is desired to load one of the bags 32, the first such bag will be lifted from the fingers 30 and the tear line 74 severed so that the hand openings 76 of the bag 32 may be guided down the inclined surfaces 46 with the spreader-hangers 52 penetrating the hand openings 76 as is shown in FIGS. 3 and 5. Thereafter, grocery or other items may be deposited in the opened bag; and when the bag has been filled, the tie tabs 72 will be gripped and knotted together to close the bag for transport.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

What is claimed is:

1. A disposable shipper-dispenser for plastic film bags comprising: a carton top member comprising a parallelepipidon having an open bottom; and a carton bottom member adapted to be slidably telescopingly received in said carton top member, including spaced sidewall elements and back panel and bottom panel elements interconnecting said sidewall elements, said elements defining a substantially open top and a substantially open front, each of said sidewall elements having a top edge which includes a downwardly and forwardly inclined bag-handle-guide edge portion and a substantially vertically extending intermediate edge portion defining a stop at the forward end of said inclined guide edge portion, each of said sidewall elements having a vertical front edge spaced forwardly apart from the respective vertically extending top edge stop portion to define a bag-handle spreader-hanger therebetween.

2. A disposable shipper-dispenser for plastic film bags according to claim 1 which further comprises a bent wire clip mountable at the top edge of said back panel and including laterally spaced, forwardly extending, substantially horizontal finger means for receiving and storing a stack of loose, tie-handle bags in ready-to-use condition.

3. A disposable shipper-dispenser for plastic film bags according to claim 1 wherein said sidewall elements define opposed, hand-hold grips therein.

4. A disposable shipper-dispenser for plastic film bags according to claim 1 wherein said carton members are fabricated from corrugated boxboard.

5. A disposable shipper-dispenser for plastic film bags comprising: a carton bottom member adapted to be slidably telescopingly received in a carton top member, including spaced sidewall elements and back panel and bottom panel elements interconnecting said sidewall elements, said elements defining a substantially open top and a substantially open front, each of said sidewall elements having a top edge which includes a downwardly and forwardly inclined bag-handle-guide edge portion and a substantially vertically extending intermediate edge portion defining a stop at the forward end of said inclined guide edge portion, each of said sidewall elements having a vertical front edge spaced apart from the respective vertically extending top edge stop portion to define a bag-handle spreader-hanger therebetween; and a plurality of plastic film bags, each of said bags having a pair of lateral apertures forming handgrips and adapted to be draped over said spreader-hangers for suspending a said bag in open condition, and each of said hand-grips including medially disposed tab means for use in tieing said bag closed.

* * * * *